US005261307A

United States Patent [19]

Domanski

[11] Patent Number: 5,261,307

[45] Date of Patent: Nov. 16, 1993

[54] SEGMENTED MUSICAL PICK

[76] Inventor: John Domanski, 11562 Iroquois Trail, Brecksville, Ohio 44141

[21] Appl. No.: 915,326

[22] Filed: Jul. 20, 1992

[51] Int. Cl.[5] ..... G10D 3/12

[52] U.S. Cl. ..... 84/322; D17/20

[58] Field of Search ..... 84/322; D17/20

[56] References Cited

U.S. PATENT DOCUMENTS 2,484,820 9/1946 Galetzky ..... 84/322

4,625,615 12/1986 Lukehart ..... 84/322

*Primary Examiner*—Michael L. Gellner

*Assistant Examiner*—Cassandra Spyrou

*Attorney, Agent, or Firm*—Leon Gilden

[57] ABSTRACT

A pick member includes a unitary plate-like construction having an upper convex edge spaced from a lower convex edge, with the upper convex edge including a plurality of finger members directed from the upper convex edge towards the lower convex edge, each of equal predetermined length, and the fingers radially oriented relative to the lower edge to provide for harmonics in use of the pick structure upon striking a musical instrument string.

5 Claims, 4 Drawing Sheets

SEGMENTED MUSICAL PICK

BACKGROUND OF THE INVENTION

1. Field of the Invention

The field of invention relates to musical pick structure, and more particularly pertains to a new and improved segmented musical pick wherein the same is arranged to provide for varying harmonics and rhythm in the striking of musical string members.

2. Description of the Prior Art

Musical picks of various configurations have been utilized in the prior art and typically such pick structure is constructed for ease of securement and grasping relative to an individual utilizing the pick structure. Such pick members are set forth in the U.S. Pat. Nos. 4,651,614 and 3,699,838.

The instant invention attempts to overcome deficiencies of the prior art by providing for a unitary pick member of a plate-like construction having finger members radially directed towards a lower edge of the pick to permit for selective dampening of the fingers when striking a chord of a musical instrument and in this respect, the present invention substantially fulfills this need.

SUMMARY OF THE INVENTION

In view of the foregoing disadvantages inherent in the known types of musical pick structure now present in the prior art, the present invention provides a segmented musical pick wherein the same employs a plurality of radially aligned fingers directed from an upper edge of the pick to a lower edge of the pick. As such, the general purpose of the present invention, which will be described subsequently in greater detail, is to provide a new and improved segmented musical pick which has all the advantages of the prior art musical pick structure and none of the disadvantages.

To attain this, the present invention provides a pick member including a unitary plate-like construction having an upper convex edge spaced from a lower convex edge, with the upper convex edge including a plurality of finger members directed from the upper convex edge towards the lower convex edge, each of equal predetermined length, and the fingers radially oriented relative to the lower edge to provide for harmonics in use of the pick structure upon striking a musical instrument string.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved segmented musical pick which has all the advantages of the prior art musical pick structure and none of the disadvantages.

It is another object of the present invention to provide a new and improved segmented musical pick which may be easily and efficiently manufactured and marketed.

It is a further object of the present invention to provide a new and improved segmented musical pick which is of a durable and reliable construction.

An even further object of the present invention is to provide a new and improved segmented musical pick which is susceptible of a low cost of manufacture with regard to both materials and labor, and which accordingly is then susceptible of low prices of sale to the consuming public, thereby making such segmented musical picks economically available to the buying public.

Still yet another object of the present invention is to provide a new and improved segmented musical pick which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
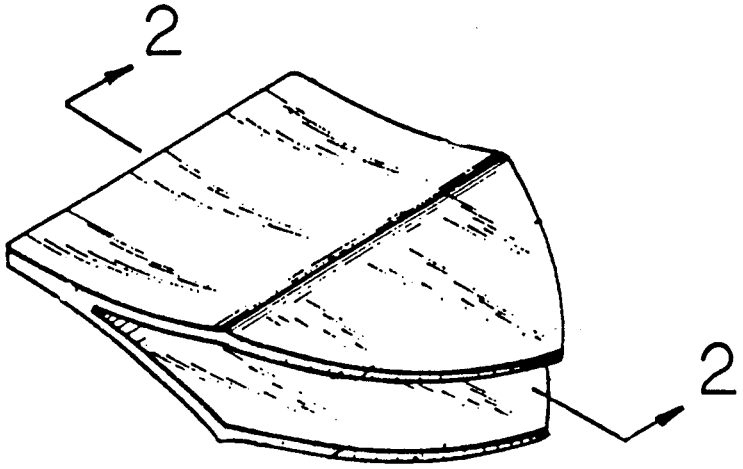
FIG 1 PRIOR ART
FIG. 1 is an isometric illustration of a prior art musical pick structure, as presented in the U.S. Pat. No. 4,651,614, having a plurality of blades spaced apart relative to one another.
Figure 2:
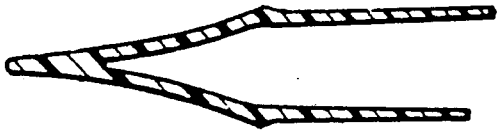
FIG 2 PRIOR ART
FIG. 2 is an orthographic view, taken along the lines 2—2 of FIG. 1 in the direction indicate by the arrows, setting forth a prior art pick structure.
Figure 3:
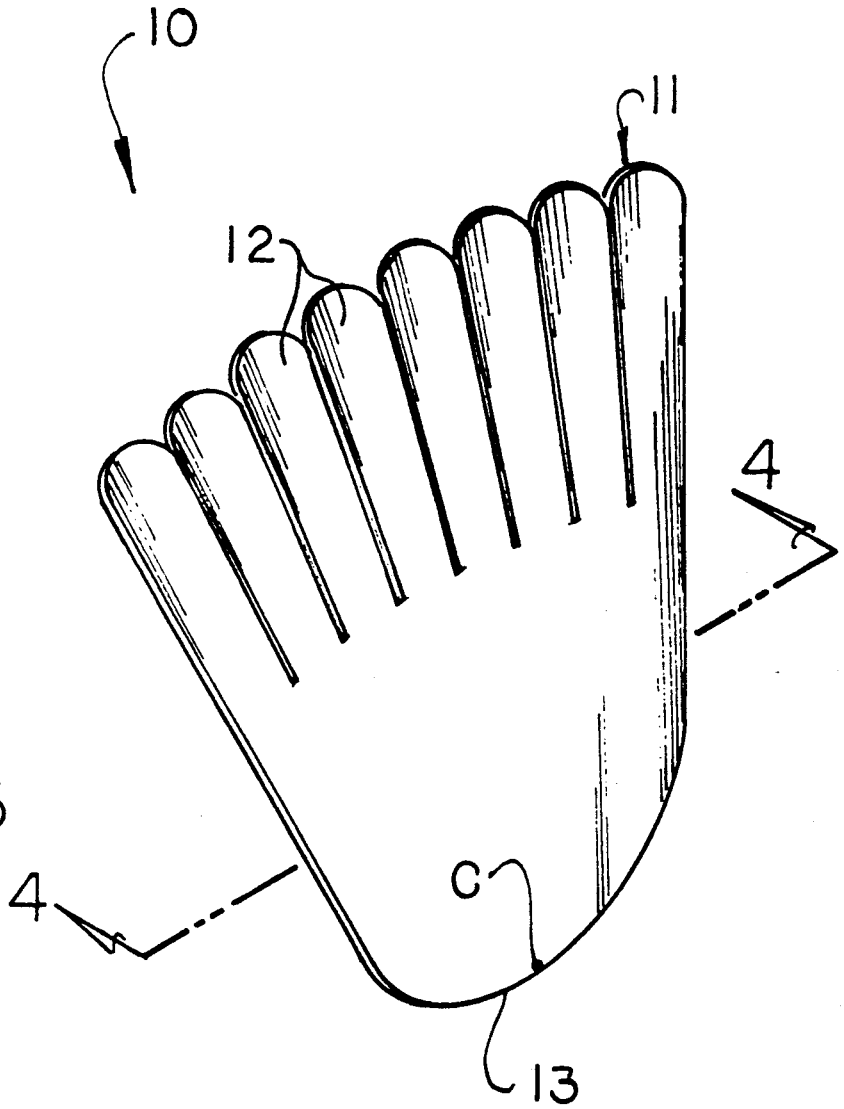
FIG. 3 is an isometric illustration of the instant invention.
Figure 4:
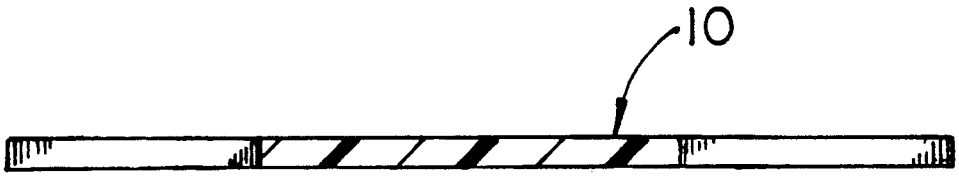
FIG. 4 is an orthographic view, taken along the lines 4—4 of FIG. 3 in the direction indicated by the arrows.
Figure 6:
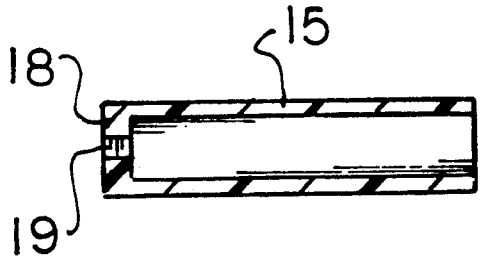
FIG. 6 is an orthographic view, taken along the lines 6—6 of FIG. 5 in the direction indicated by the arrows.
Figure 7:
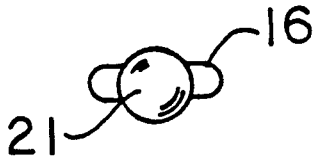
FIG. 7 is an orthographic view, taken along the lines 7—7 of FIG. 5 in the direction indicated by the arrows.

With reference now to the drawings, and in particular to FIGS. 1 to 8 thereof, a new and improved segmented musical pick embodying the principles and concepts of the present invention and generally designated by the reference numeral 10 will be described.

More specifically, the segmented musical pick 10 of the instant invention essentially comprises a unitary body plate formed of a polymeric material having an upper convex curvilinear periphery 11 spaced from a lower convex edge 13 and angulated first and second sides 23 and 24 canted towards one another from the upper periphery 11 to the lower edge 13. A plurality of finger segments 12 are directed coextensively in a coextensive relationship relative to one another extending from the first side 23 to the second side 24, wherein the finger segments each are of an equal predetermined length and radially oriented about a single center that is oriented on the lower convex edge 13 in a desired configuration of the organization or alternatively, positioned exteriorly of the unitary body in adjacency to the lower edge 13. This radial center line "C" is indicated for purposes of illustration on the lower edge 13, but it is understood that the radial center "C" may be positioned exteriorly of the body relative to the lower edge 13.

Figure 5:
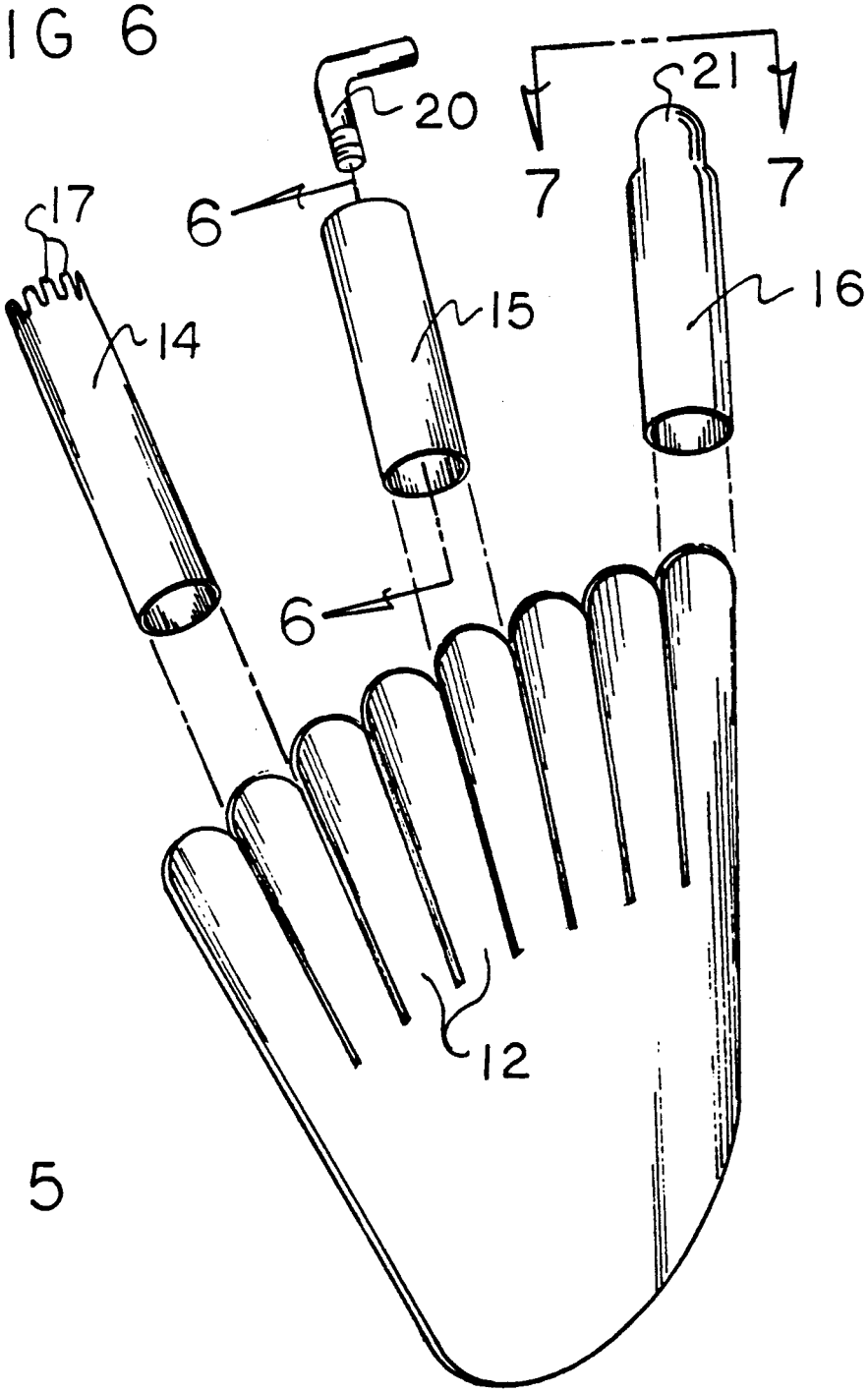
FIG. 5 is an isometric illustration of the invention optionally employing sleeve members thereon.

The FIG. 5 indicates the invention that may optionally employ one or a plurality of various tube members defined by respective first, second, and third tube members 14, 15, and 16 respectively, each also of said predetermined length arranged for slidingly mounting on one of the finger segments 12 to vary the harmonics and the manner of addressing of a string member by the pick 10 in use. The tube member 14 includes a first tube outer edge annular array of fingers 17, wherein the second tube includes a second tube end wall 18 having a threaded bore 19 to threadedly receive and L-shaped strumming rod 20 oriented to overlie the upper edge 11 to access and strike a plurality of string members in a manner prior to the striking of such string members by the upper periphery 11. The third tube member 16 includes a third tube resilient cylindrical projection 21. It should be noted that the use of the tubes, as well as the finger members, is employed to alter the harmonics in striking of a string instrument in use of the organization. It should be further noted that the free edges of the fingers 12 along the upper periphery 11 may be configured that each finger 12 is of a curvilinear, blunt, or convex configuration, wherein the curvilinear configuration of each finger member as illustrated is of the preferred embodiment.

Figure 8:
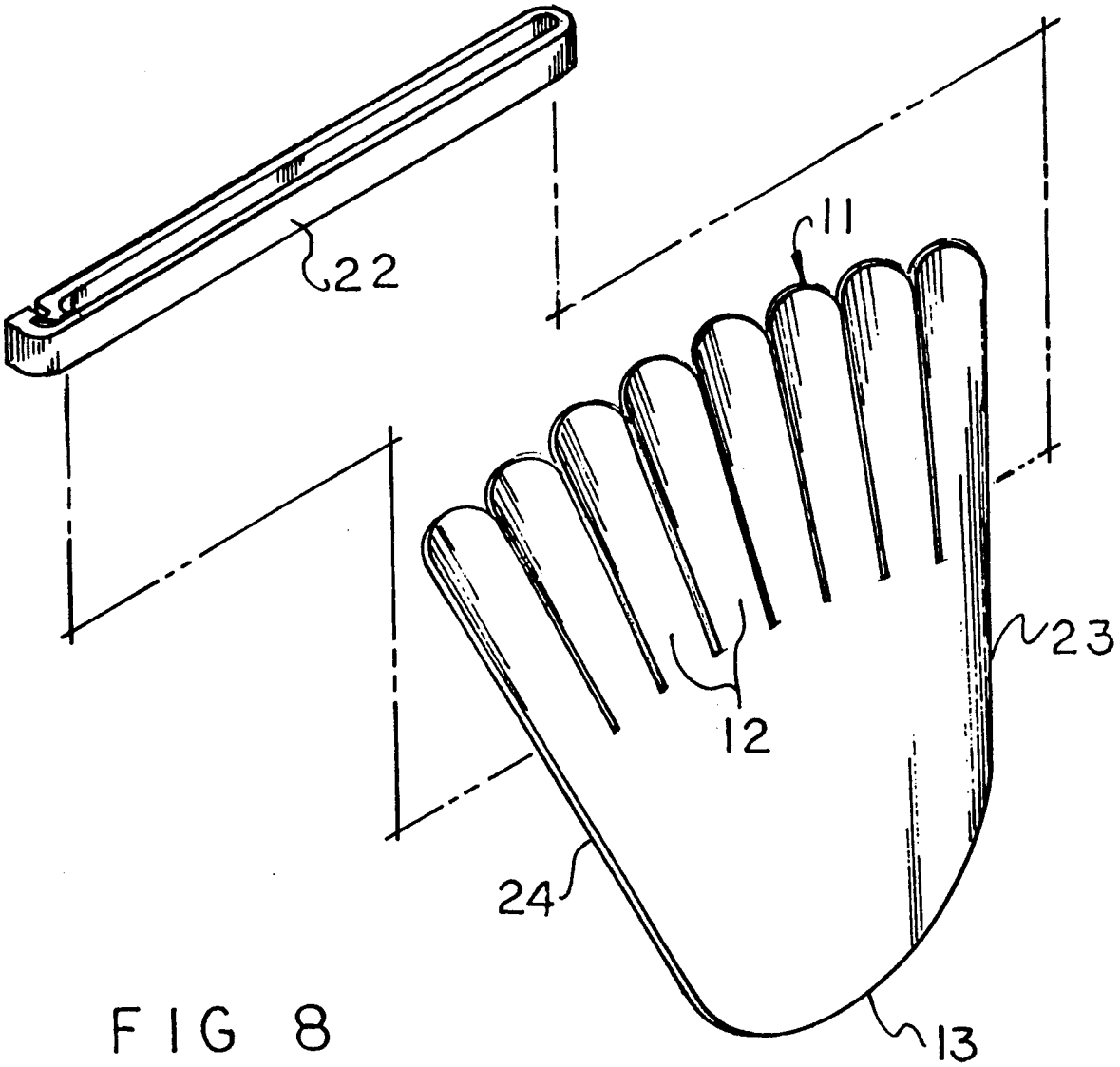
FIG. 8 is an isometric illustration of the invention illustrating the organization to further include a slide clamp arranged for dampening harmonics in use of the pick structure.

The FIG. 8 indicates the use of a slide clamp 22 that extends surroundingly about the pick 10 and about the fingers extending between the first side and the second side 23 and 24 respectively, whereupon sliding of the slide clamp 21 between the lower edge 13 and the upper curvilinear periphery 11 is utilized to alter the harmonics in the addressing of a string instrument in use of the musical pick structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A segmented musical pick, comprising, a unitary body plate formed of a polymeric flexible shape-retentent material having an upper convex curvilinear periphery spaced from a lower convex edge, and a first side spaced from a second side, with the first side and the second side canted towards one another extending from the upper periphery to the lower edge, and a plurality of finger segments extending coextensively between the first side and the second side, wherein the finger segments are each of an equal predetermined length and each of the finger segments are oriented about a common radial center, and the common radial center is positioned in adjacency to the lower convex edge, and at least a first tube member, a second tube member, and a third tube member are provided, wherein each of said first, second, and third tube members are arranged for sliding reception upon respective individual finger segments of said finger segments.

2. A musical pick as set forth in claim 1 wherein the first tube member, the second tube member, and the third tube member are each of an equal length equal to said predetermined length, and wherein the first tube member includes a first tube outer edge positioned in adjacency relative to the upper curvilinear periphery when positioned upon one of said finger segments, and wherein the first tube outer edge includes an annular array of tube finger members.

3. A musical pick as set forth in claim 1 wherein the second tube member includes a second tube end wall, and the second tube end wall includes a threaded bore, and the threaded bore is arranged for threaded reception of an L-shaped strumming rod, with the strumming rod oriented to overlie the upper curvilinear periphery when mounted upon the second tube end wall.

4. A musical pick as set forth in claim 3 wherein the third tube member includes a resilient projection extending beyond the third tube member.

5. A musical pick as set forth in claim 3 including a slide clamp, wherein the slide clamp extends in surrounding relationship relative to the finger segments and extends from the first side to the second side to define a continuous band.

* * * * *